United States Patent [19]

Dailey et al.

[11] 4,200,260

[45] Apr. 29, 1980

[54] PICKET FENCE STRUCTURE

[76] Inventors: Thomas C. Dailey, 11714C E. 21st Pl., Tulsa, Okla. 74129; Robert C. Dailey, 5200 S. Yale-Suite 306, Tulsa, Okla. 74135

[21] Appl. No.: 887,960

[22] Filed: Mar. 20, 1978

[51] Int. Cl.[2] ..... E04H 17/16

[52] U.S. Cl. ..... 256/24

[58] Field of Search ..... 256/24, 29, 19, 73, 256/62, 65, 71, DIG. 4; 403/292, 295; 52/585, 586, 627, 745

[56] References Cited

U.S. PATENT DOCUMENTS

| | | | |
|---|---|---|---|
| 1,672,562 | 6/1928 | Evans | 403/295 X |
| 2,721,727 | 10/1955 | Eddy | 256/19 X |
| 2,918,261 | 12/1959 | Bergeron | 256/24 |
| 3,111,303 | 11/1963 | Olson | 256/19 |
| 3,343,319 | 9/1967 | Reintjes | 52/585 X |

FOREIGN PATENT DOCUMENTS

| | | | |
|---|---|---|---|
| 399024 | 9/1933 | United Kingdom | 52/585 |
| 1248237 | 9/1971 | United Kingdom | 256/24 |

*Primary Examiner*—Werner H. Schroeder

*Assistant Examiner*—Doris L. Troutman

*Attorney, Agent, or Firm*—James H. Chafin

[57] ABSTRACT

A picket fence structure comprising a plurality of coplanar contiguous vertical pickets which have at least one key slot cut into each edge, so that the mating edges of two adjacent pickets have their key slots in the same position. A key is placed in each key slot, which serves to keep the pickets in a planar assembly. There are preferably two key slots, one near each end, on each edge of the pickets. The planar assembly of pickets, held together by suitable keys in the key slots, are keyed to fence posts contiguous with the outermost pickets. The keying of the outermost pickets to adjacent fence posts, can be by longitudinal grooves or slots in the faces of the fence posts, or by means of key slots similar to those which hold the individual pickets into a planar assembly. The keys may be rods or dowels. They are preferably discs of a diameter that will fit into semi-circular key slots in the matching edges of the pickets. If the key slots are elongated, with a key in adjacent key ways, the adjacent pickets can have relative longitudinal movement to conform to a sloping ground surface.

5 Claims, 15 Drawing Figures

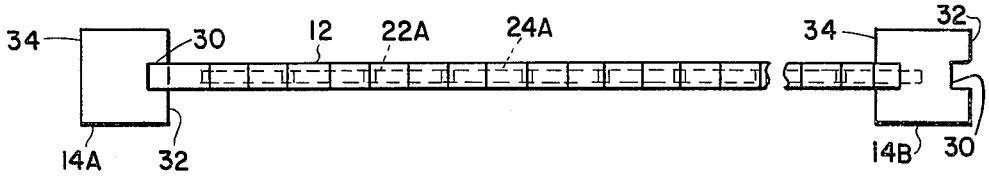
Fig. 3
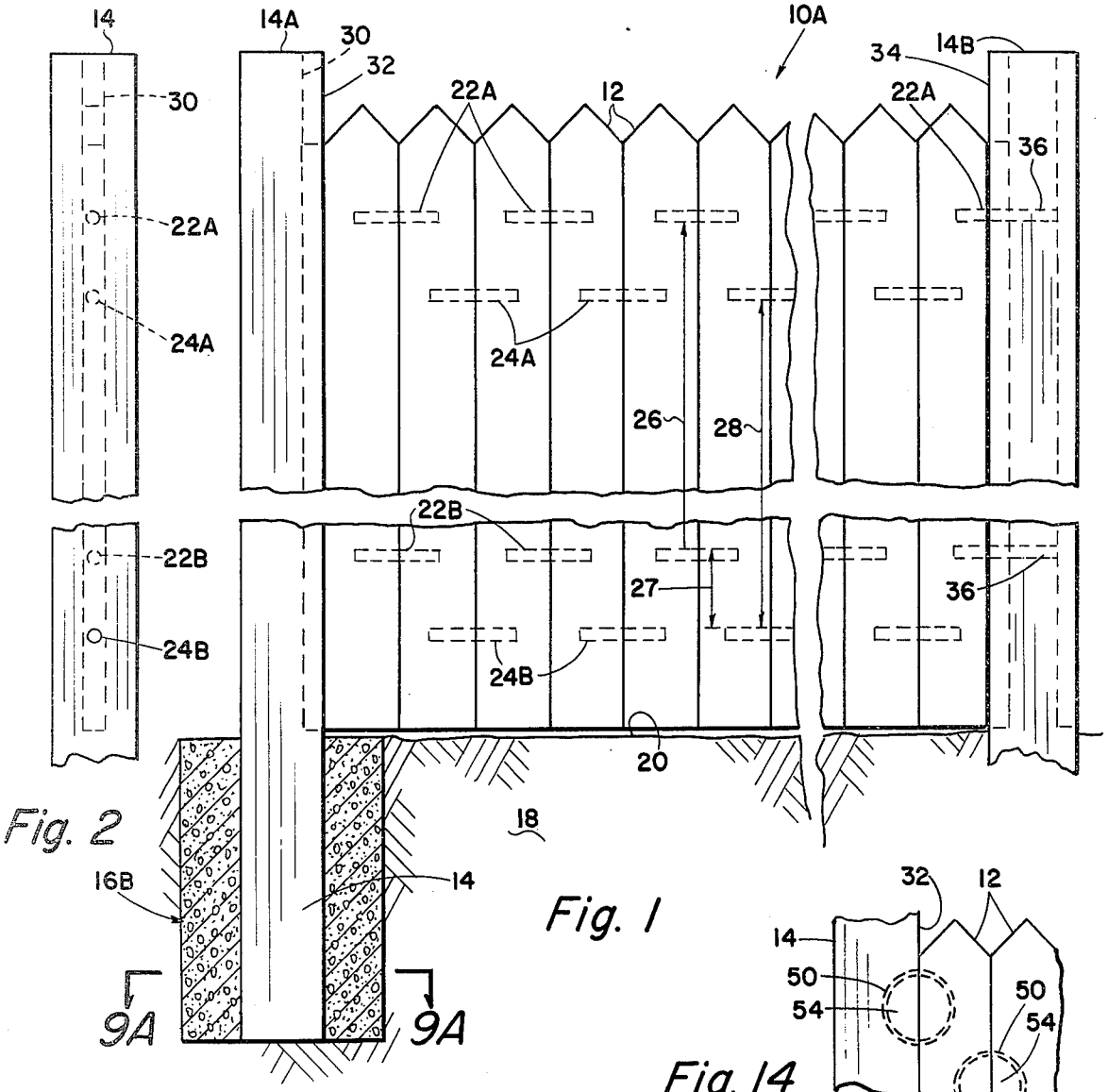
Fig. 2
Fig. 1
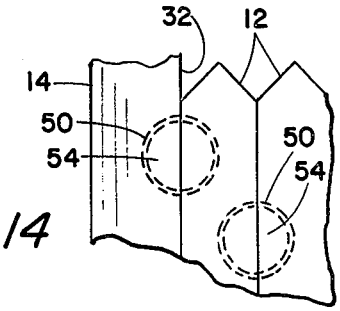
Fig. 14
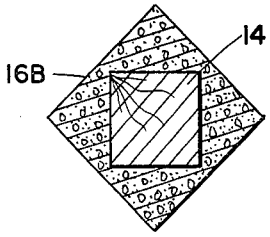
Fig. 9A
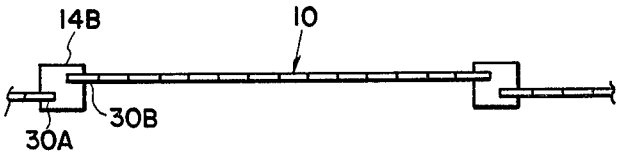
Fig. 4

PICKET FENCE STRUCTURE

BACKGROUND OF THE INVENTION

1. Field of the Invention

This invention lies in the field of outdoor walls or fences. More particularly, it concerns a construction of a fence having coplanar, parallel, contiguous or spaced apart pickets, which may be flat strips, or they can be cylindrical or semicylindrical rods, etc.

More particularly, it concerns an improved method of holding a plurality of contiguous picket elements into a planar configuration by means of key slots and suitable keys, recessed into the matching edges of contiguous picket elements.

2. Description of the Prior Art

In the prior art, various methods of constructing picket fences have been illustrated which, almost entirely have been constructed in either of two forms; one form involves the use of a plurality of drilled holes through the pickets, perpendicular to the length, from one edge to the other, and provision of a long metal rod which is inserted through successive holes in adjacent pickets. The long metal rod is anchored in fence posts adjacent to the outermost pickets.

A second conventional form is to provide a pair of spaced horizontal rails, to which the individual pickets are nailed to provide a planar assembly.

SUMMARY OF THE INVENTION

It is a primary object of this invention to provide a picket fence by means of which a plurality of picket elements can be locked to each other in a planar assembly, and to a pair of posts adjacent the outermost pickets, without having external beams, rails, or braces to hold the pickets in a planar assembly.

It is a further object of this invention to provide a type of fence construction that permits disassembly of the fence picket elements, and reassembly without damage to the individual pickets while still maintaining a substantially planar fence.

These and other objects are realized and the limitations of the prior art are overcome in this invention by providing picket elements which are identical to each other, and are placed in mating position, edge-to-edge, of adjacent picket elements. The elements can be complete pickets or short portions of pickets forming spacers, so that a spaced relation between the full pickets is provided.

Each individual pair of contiguous pickets are keyed to each other, by means of key slots cut into the mating edges, and provision of a suitable key. The key may be of wood or metal, that is placed in the key slot prior to positioning the two edges of adjacent picket elements together.

The preferred shape of the key slot is in the form of a semi-circular groove, such that two adjacent semi-circular grooves or key slots on mating edges will be held coplanar by inserting a key into the slots, which can be of a circular disc form, of a thickness equal substantially to the width of the key slots, and of a diameter slightly less than the depth of the slots. Other types of keys and key slots, such as rectangular or rod-like, can be used.

An improved key slot is one in which a semi-circular key slot is elongated a selected dimension, such as by using a circular cutter and advancing the cutter longitudinally along the edge of the picket element. This provides additional benefits in that a circular disc key in such a slot, permits the two adjacent picket elements to be moved longitudinally relative to each other, so that the picket elements can accommodate a sloping ground surface, for example, and still maintain a rigid planar structure.

In order to provide maximum stiffness of the structure, the keys and key ways should be of substantially the same thickness. Also, by setting the key ways in opposite edges of a picket at different longitudinal positions, the key ways can be of such depth that the key slot can be greater than half the width of the picket and therefore provide for greater rigidity of the structure.

Another feature of the key and key slot-type type of assembly, is that if it is desired to have a permanently assembled panel of pickets, the pickets will be made of wood, and the keys in the form of circular discs can be made of wood, and suitable adhesive or glue can be applied to the surfaces of the key and the key slots so that once the fence is assembled the keys and key slots will be formed into a rigid monolithic assembly.

The picket assembly can be supported on fence posts by any keying method desired. One such keying method involves cutting longitudinal grooves of width equal to the thickness of the pickets, in the facing walls of two spaced posts. Thus, the previously prepared planar picket assembly can be inserted into the slots. Conversely the posts can be keyed to the outermost pickets in the same manner that the individual pickets are keyed to each other.

A type of fence post support means is described, which comprises a cast concrete cylinder of selected length and diameter, which has an axial opening adapted to tightly receive the bottom end of the fence post, so that the post can be removed if desired and the fence can be disassembled and reassembled at will.

BRIEF DESCRIPTION OF THE DRAWINGS

These and other objects and advantages of this invention and a better understanding of the principles and details of the invention will be evident from the following description taken in conjunction with the appended drawings in which:

FIGS. 1, 2, 3 and 4 indicate different views of one embodiment of this invention.

FIGS. 8, 9 and 9A illustrate views of a fence post support member.

FIGS. 10, 11, 12, 13 and 14 illustrate views of another embodiment of this invention using a semi-circular key slot.

DESCRIPTION OF THE PREFERRED EMBODIMENT

Figure 7:
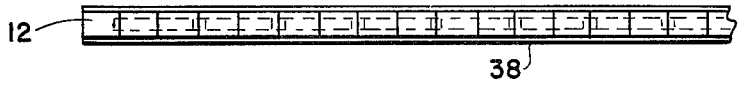
FIGS. 5, 6 and 7 indicate separate views of a second embodiment of the invention.

Referring now to the drawings, and in particular to FIGS. 1, 2, 3 and 4, there is shown one embodiment of this invention. It comprises a picket fence indicated generally by the numeral 10A, having a plurality of similar pickets 12 each of the same length and same width, if desired, which are locked together in planar relation by suitable key slots and keys, in contiguous edges of the pairs of pickets. It is preferably desirable to have at least two key slots and keys 22A and 22B on contiguous faces.

Furthermore, it is desirable to have the position of the pair of key slots and keys on opposite edges of a picket to be at different selected distances from one end of the pickets. This makes it possible then to have the key slots and keys extend more than half way through the width of a picket, without seriously mechanically weakening the picket, by interference between the key slots on opposite edges. Thus, having the spacing 26 between key slots and keys 22A and 22B equal to 28 the dimension between the key slots and keys 24A and 24B offset by a distance 27, for example, provides a stronger assembly than if the key ways 22A and 24A were colinear on opposite edges of each of the pickets.

Figure 5:
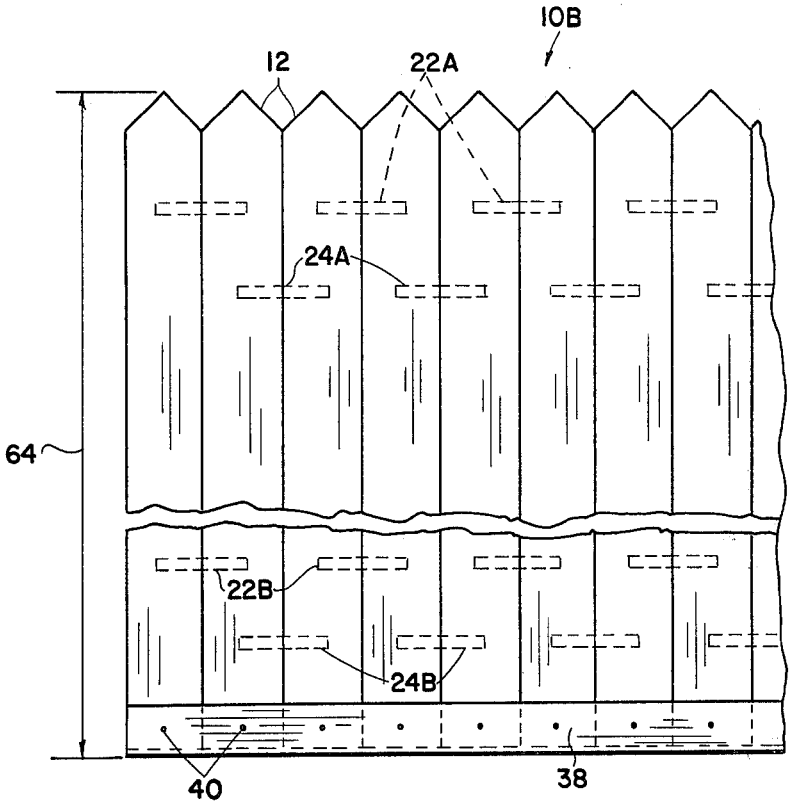
Figure 10:
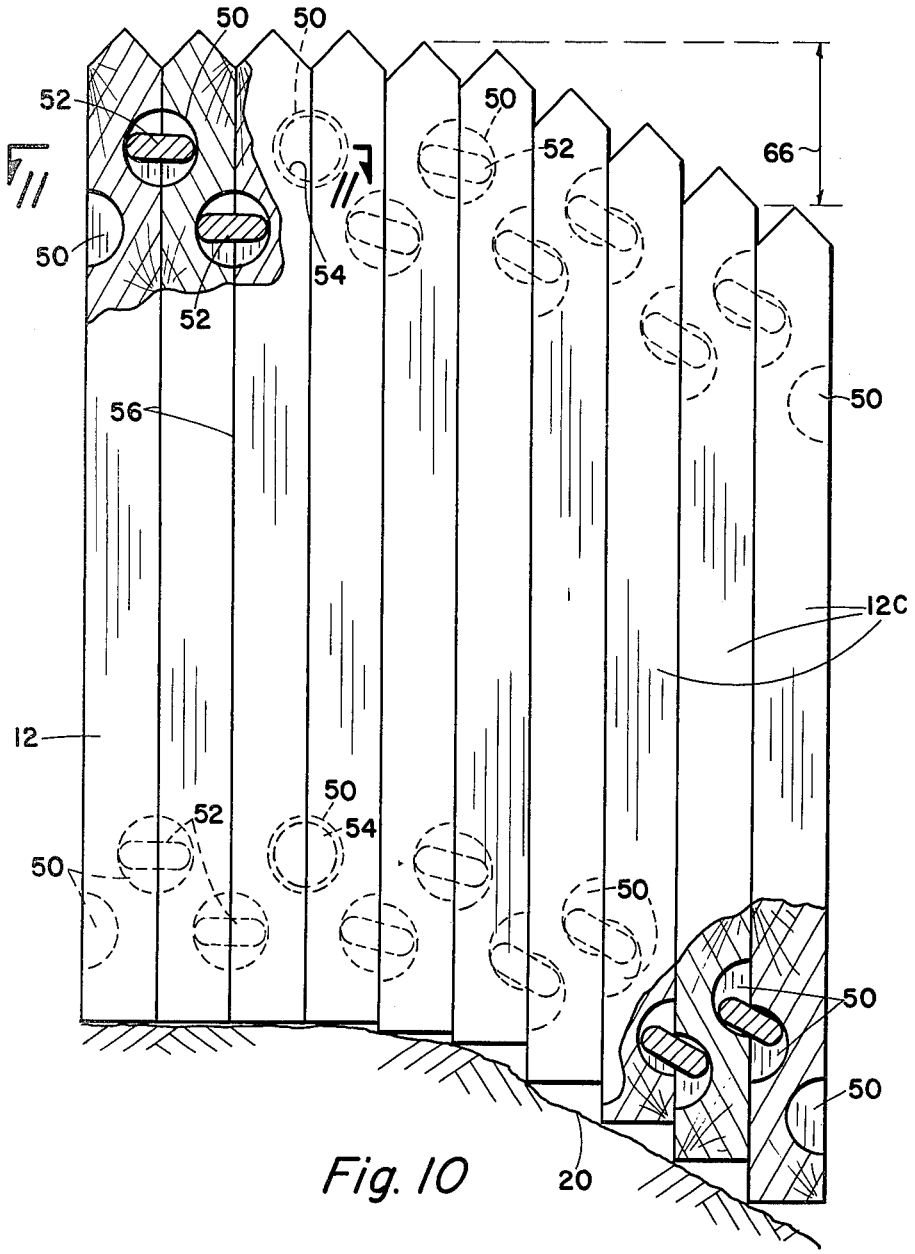

By the use of the key ways and keys shown in FIGS. 1, 5 and 10 for example, the plurality of pickets can be formed into a substantially ridged, planar assembly, or panel, which can be then inserted into key ways such as the grooves 30 on the facing parallel spaced edges 32 and 34 of two posts 14A and 14B, for example, as in FIG. 1 and 3.

If there are at least a pair of panels 10A on opposite sides 32, 34 of a post 14B, the slots 30 can be coplanar as in FIG. 3 or they can be offset as in FIG. 4 to provide greater strength to the post.

Figure 6:
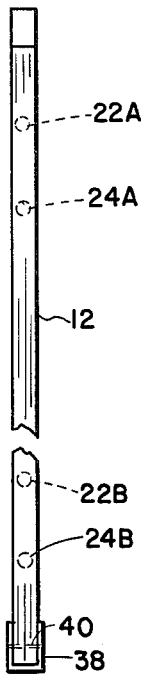

Shown in FIGS. 5, 6 and 7 is a variation 10B of the picket panel 10A of FIG. 1. This has a U-shaped channel member 38 which is positioned over the bottom edges of the panel or pickets and is held to the pickets by means such as nails or screws 40. The channel member 38 can be made of metal or plastic, or other selected material. With this additional mechanical support, it may be possible to avoid the use of the bottom rows of key slots and keys 22B and 24B, since the support which these keys and key slots would provide, is provided by the channel member 38.

Figure 8:
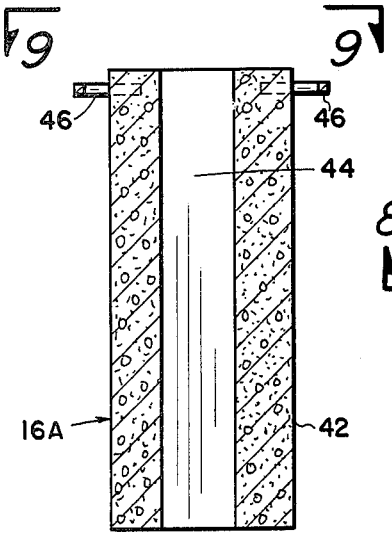
Figure 9:
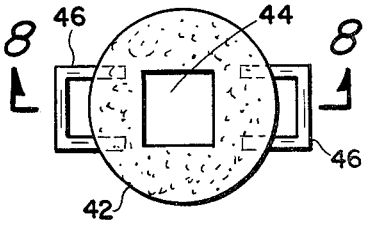

Referring now to FIGS. 8 and 9, there is shown one embodiment of a fence post support means 16, which comprises a cylindrical concrete unit of selected diameter and length, which has an axial opening 44 of the proper shape and size to receive the bottom portion of the fence post, as in FIG. 1.

The weight and size of the fence post support member 16A can be any value selected, such that when inserted into an opening in the earth, of substantially the same diameter as the outer surface 42 of the support member, and with the earth thoroughly tamped around the support member, a support for the fence posts is provided which will be comparable to that in which cement is poured around the base of the post in a prepared hole of substantially the same diameter and depth. However, in the form as shown in FIGS. 8 and 9, if it is desired to move the fence, the support member 16 can be dug up and reused in a new location.

If desired, handles such as 46 can be cast into the concrete for facilitating the lifting and positioning of the support member.

While the cross-section of the support member is shown in FIG. 9 is circular, it could equally well be of another shape such as triangular or square, which would provide greater resistance against bending in a selected direction. This is illustrated in FIG. 9A where a post support member is shown of square cross-section, for the same volume of concrete, the diagonal dimension is greater than the diameter of 16A, which provides a larger area for resistance against rotation of the post in the earth.

In FIGS. 1 and 5, there are shown key slots and keys which are of the nature of drilled openings perpendicular to the edges of the pickets into which cylindrical pins or dowels are inserted as keys.

Figure 11:
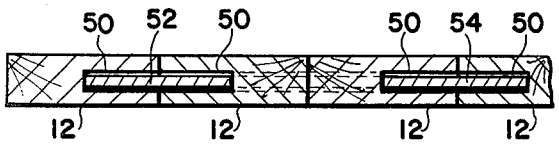

A more useful and preferred type of key slot and key is shown in FIGS. 10 and 11 where the key slots are shown as semi-circular grooves in the edges of the pickets, the longitudinal spacing would correspond to that of the slots and keys in FIGS. 1 and 5, for example. That is, the individual keys on opposite edges of a picket would be offset longitudinally one from the other to provide a deeper key slot without seriously weakening the picket. The key slots are shown as semi-circular grooves 50 such as might be cut by a circular cutter. Two types of keys are shown, a rod type key 52 which is of length equal to double the depth of the semi-circular key slot, and also a preferred type of key, which is a circular disc 54, which substantially fills key slot and makes for a tighter more rigid planar assembly, or panel, of the plurality of pickets.

With the semi-circular key slots 50, and the rod type keys 52, as shown with the right hand group of pickets 12C, the individual pickets can be slid, one with respect to the other, to accommodate the bottom edge against the sloping surface 20 of the earth. This is possible because of the greater length of the grooves 50, compared to the narrow width of the rod type key 52 which permits this longitudinal movement while still providing a solid restraint of the key in the slot.

Figure 12:
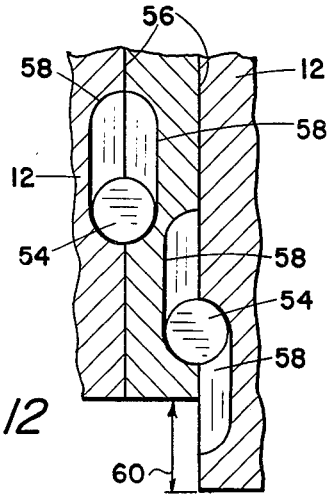

A corresponding advantage is illustrated in FIG. 12 of the situation as in FIG. 10, where a circular key 54, is utilized but the key slot 58 is extended a selected distance by advancing the cutter along the edge of the picket. Thus, it is possible to shift two adjacent pickets by a distance 60, and still have a circular key fit properly into the key slots.

As mentioned earlier, it is possible to use a wooden disc, for example, of the proper width to fit in the groove in the key slot and to glue the key into the two slots, to provide a very strong rigid panel of pickets.

In all the previous illustrations, the pickets 12 are shown all of substantially the same length 64 as shown in FIG. 5. However, where the ground surface as in FIG. 10 is not horizontal, it may be desirable to lengthen the pickets by a dimension 66, so that, although the bottom edges follow the contour of the surface 20 of the earth, the tops of the pickets will all be in a horizontal line.

Figure 13:
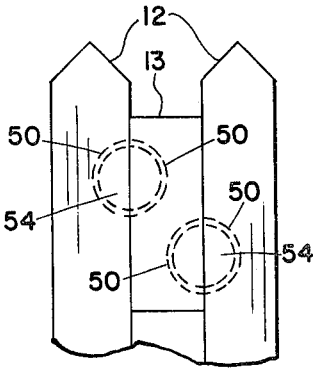

In FIG. 13 is shown a variation of the arrangement of FIGS. 1 and 5 wherein alternate pickets are replaced with short lengths of wood of the same width and thickness as the pickets, but limited in length, to at least provide for the presence of two spaced key slots in the edges of the spacer 13. With spacers 13 at the top rows of key slots, and at the bottom rows of key slots, the picket fence would have a much more open nature, which would provide a variation in the type of fence indicated in FIGS. 1 and 5.

As shown in FIGS. 1, 2, 3 and 4, the panels of pickets keyed together can be inserted into longitudinal grooves such as 30 in the matching faces 32 and 34 of the posts 14A and 14B for example. However, it is possible to assemble the panel of pickets against the surface 32 of the post 14 by means of semi-circular key slots as indicated in FIG. 14, for example. This is illustrated for the rod type keys in the post 14B of FIG. 1 where an elongated rod-like key is used in a drilled opening 36 in the post. This key way 36 can be used with or without the slots 34.

FIG. 14 illustrates the use of a semi-circular key slot 50 in the picket 12 and the post 14, with a circular key 54 similar to those joining adjacent pickets. Here again a key slot longer than the key can be used to permit longitudinal relative positioning of the post and the pickets.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A fence structure comprising:

(a) a plurality of elongated pickets oriented parallel to each other;

(b) at least one first key slot cut part way into one edge of each picket, at least one second key slot cut part way into the opposite edge of each picket and being longitudinally offset from the first key slot, each key slot having width less than the thickness of the picket;

(c) the position of said key slots on mating edges of adjacent pickets being in substantial transverse alignment;

(d) a plurality of keys adapted to be placed and held, one in each pair of aligned key slots;

(e) wherein each said key slot comprises a semi-circular key slot cut into the edge of each picket, said key slot positioned symmetrically with respect to the two edges, and of depth substantially equal to the radius of said semi-circle, and wherein each of said keys is a circular disc of thickness substantially equal to the width of said semi-circular key slot.

2. The fence structure as in claim 1 including a U-shaped channel member positioned over the bottom edges of said pickets, and means to attach said channel member to the bottom ends of said pickets.

3. A fence structure comprising a plurality of vertical pickets;

(a) at least one elongated semi-circular key slot cut into each edge of each picket, the positions of said key slots with respect to one end of said pickets being spaced apart by a selected distance;

(b) the position of said key slots on mating edges of adjacent pickets being at equal distances from said one end;

(c) a plurality of circular keys adapted to be placed and held, one in each pair of key slots on adjacent edges of said pickets.

4. A fence structure comprising a plurality of elongated pickets oriented parallel to each other, at least one first key slot cut part way into one edge of each picket, at least one second key slot cut part way into the opposite edge of each picket and being longitudinally offset from the first key slot, the position of said key slots on mating edges of adjacent pickets being in substantial transverse alignment, a plurality of keys adapted to be placed and held, one in each pair of aligned key slots, wherein alternate pickets are of reduced length, said length at least long enough to include at least one key slot on each side thereof.

5. A fence structure comprising a plurality of elongated pickets oriented parallel to each other, at least one first key slot cut part way into one edge of each picket, at least one second key slot cut part way into the opposite edge of each picket and being longitudinally offset from the first key slot, the position of said key slots on the mating edges of adjacent pickets being in substantial transverse alignment, a plurality of keys adapted to be placed and held, one in each pair of aligned key slots, at least two spaced fence posts and including means to key the outermost pickets to said posts, a fence post support member comprising a cylindrical concrete unit of selected dimensions, and having an axial opening to receive said posts, the cross-section of said cylindrical concrete units being square and positioned in the earth with a diagonal in the plane of the panel of pickets.

* * * * *